US007334789B2

(12) United States Patent
Herrmann et al.

(10) Patent No.: US 7,334,789 B2
(45) Date of Patent: Feb. 26, 2008

(54) PRINTED SHEETS STACKING TRAY WITH AUTOMATIC ALTERNATE STACKING SUPPORT AND MANUAL STACK LIFTING ASSISTANCE

(75) Inventors: Douglas K. Herrmann, Webster, NY (US); Richard V. Williams, Rochester, NY (US); Steven D. Olson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 451 days.

(21) Appl. No.: 11/115,443

(22) Filed: Apr. 27, 2005

(65) Prior Publication Data

US 2006/0244202 A1 Nov. 2, 2006

(51) Int. Cl.
*B65H 1/00* (2006.01)

(52) U.S. Cl. ..... 271/145; 271/147; 271/157; 271/162

(58) Field of Classification Search ..... 271/145, 271/157, 162, 164, 147, 148; 399/393
See application file for complete search history.

(56) References Cited

U.S. PATENT DOCUMENTS 4,219,192 A * 8/1980 Burke ..... 271/160
4,504,053 A * 3/1985 Shiozawa ..... 271/34
5,045,881 A 9/1991 Kinder et al.
5,261,655 A 11/1993 Keller et al.
5,318,401 A 6/1994 Mandel
5,685,529 A 11/1997 McFarland
5,915,687 A 6/1999 Rieck

* cited by examiner

*Primary Examiner*—David H Bollinger
(74) *Attorney, Agent, or Firm*—James J. Ralabate; Paul F. Morgan

(57) ABSTRACT

In a sheet stacking and unloading system in which sheets are stacked on a stacking tray which is then moved from its sheet stacking position to an unloading position for removing the sheet stack from the stacking tray, and the stacking tray has a sheet stacking surface partially interrupted by at least one handhold area for allowing manual lifting access underneath a portion of a stack, there is automatically inserted into the handhold area at least one supplemental sheet stack supporting member to provide supplemental sheet stacking support, preventing the sheets from sagging in those areas, which supplemental sheet stack supporting member is automatically removed from the handhold area when the stacking tray is moved to its unloading position.

6 Claims, 5 Drawing Sheets

FIG. 1
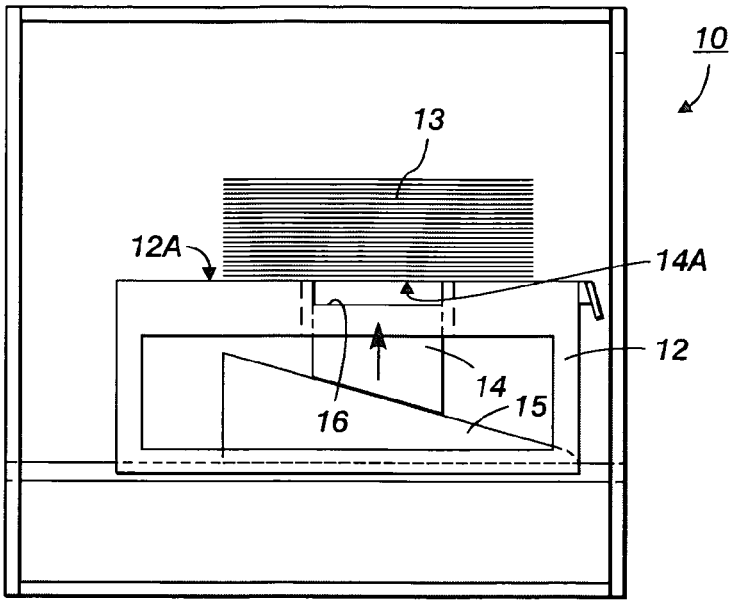
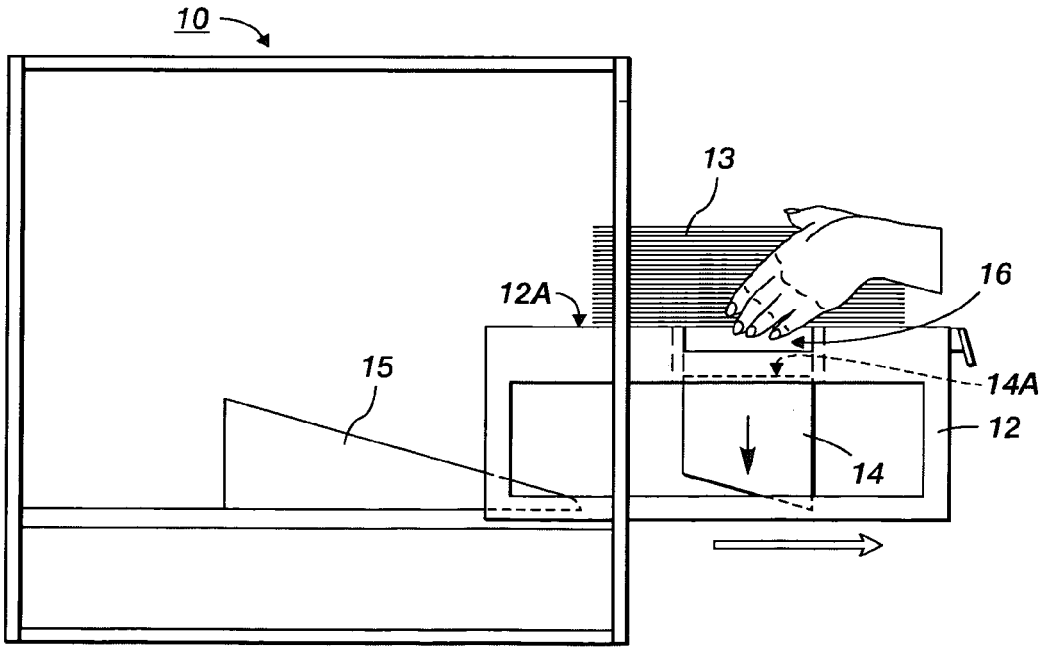
FIG. 2

FIG. 3
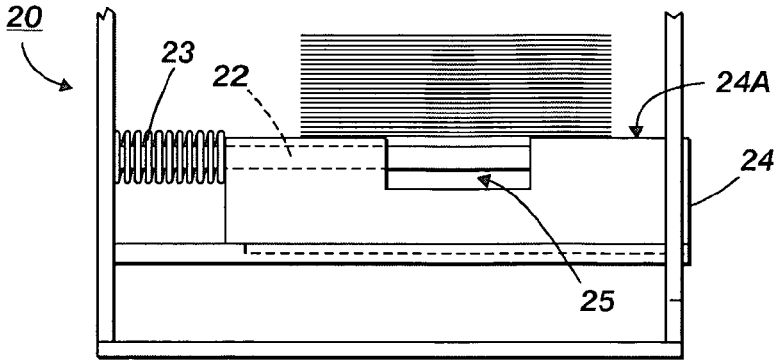
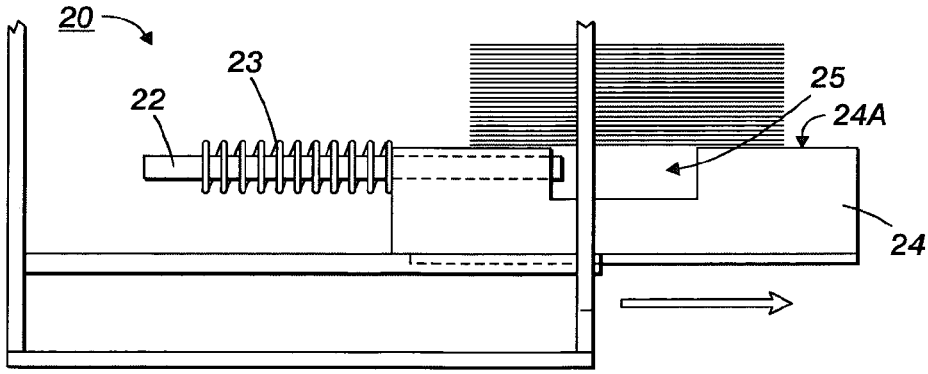
FIG. 4

PRINTED SHEETS STACKING TRAY WITH AUTOMATIC ALTERNATE STACKING SUPPORT AND MANUAL STACK LIFTING ASSISTANCE

Disclosed in the embodiments herein is an improved yet low cost system for providing non-sagging stacking tray support for the proper stacking of sheets, such as the typical flimsy printed paper sheets outputted in large numbers by a printer, yet also providing for underlying operator handholds assistance for the subsequent manual unloading and removal of such stacked sheets.

Numerous types of sheet stacking trays are known in the highly developed printing art over many years. The following Xerox Corp. U.S. patent disclosures are noted and incorporated by reference by way of background and for appropriate alternative or additional details: U.S. Pat. Nos. 5,685,529; 5,915,687; 5,261,655; 5,045,881; 5,318,401; and other art cited therein.

A specific feature of the specific embodiments disclosed herein is to provide a sheet stacking and unloading system in which sheets are stacked on a stacking tray, which stacking tray is movable between a sheet stacking position for stacking sheets on said stacking tray and a sheet stack unloading position for removing sheet stacks from said stacking tray, and which stacking tray has a sheet stacking surface partially interrupted by at least one handhold area for allowing manual access underneath a stack of sheets on said sheet stacking surface for said stack unloading, wherein a supplemental stack supporting mechanism is provided which automatically provides at least one temporary additional supplemental sheet stacking surface support in said partially interrupted handhold area in response to said movement of said stacking tray into said sheet stacking position, and wherein said temporary additional supplemental sheet stacking surface support is automatically substantially removed from said partially interrupted handhold areas in response to said movement of said stacking tray into said sheet stack unloading position.

Further specific features disclosed in the embodiments herein, individually or in combination, include those wherein said supplemental stack supporting mechanism is driven solely by said movement of said stacking tray between said sheet stacking position and said sheet stack unloading position; and/or wherein said supplemental stack supporting mechanism is actuated solely by engagement with a fixed camming surface during said movement of said stacking tray between said sheet stacking position and said sheet stack unloading position; and/or wherein which sheets are stacked on a dual mode stacking tray operable between a sheet stacking mode for stacking sheets on said stacking tray and a sheet stack unloading mode for removing sheet stacks from said stacking tray, which stacking tray has a sheet stacking surface partially interrupted by at least one handhold area for allowing manual access underneath a portion of a stack of sheets on said sheet stacking surface for said stack unloading, further including at least one supplemental stack supporting member automatically inserted said handhold area to provide an extension of said sheet stacking surface in said sheet stacking mode of said stacking tray, and wherein said supplemental sheet stack supporting member is automatically removed from said handhold area in said sheet stack unloading mode of said stacking tray; and/or wherein said dual mode stacking tray is horizontally manually movable between said sheet stacking mode and said sheet stack unloading mode; and/or wherein said supplemental stack supporting member is actuated solely by said manual movement of said stacking tray between said sheet stacking mode and said sheet stack unloading mode; and/or further including a fixed camming member, and/or wherein said dual mode stacking tray is horizontally manually movable between said sheet stacking mode and said sheet stack unloading mode; and/or wherein said supplemental stack supporting member is an integral unit movable with said sheet stacking tray and vertically actuated solely by engagement with a fixed camming member; and/or a sheet stacking and unloading method in which sheets are stacked on a stacking tray which is moved between a sheet stacking position for stacking sheets on said stacking tray and a sheet stack unloading position for removing sheet stacks from said stacking tray, which stacking tray has a sheet stacking surface which is partially interrupted by at least one handhold area for allowing manual access underneath a portion of a stack of sheets on said sheet stacking surface for lifting said stack, automatically inserting at least one supplemental sheet stack supporting member into said at least one handhold area to provide supplemental sheet stack support in said handhold area in said sheet stacking position of said stacking tray, and automatically removing said supplemental sheet stack supporting member from said handhold area in said sheet stack unloading mode of said stacking tray; and/or wherein said stacking tray is manually horizontally moved between said sheet stacking position and said sheet stack unloading position, and wherein said supplemental sheet stack supporting member is solely moved by said manual movement of said stacking tray between said sheet stacking position and said sheet stack unloading position; and/or wherein said supplemental sheet stack supporting member is movable with said stacking tray and is moved vertically solely by engagement with said fixed camming member.

The term "reproduction apparatus" or "printer" as used herein broadly encompasses various printers, copiers or multifunction machines or systems, xerographic or otherwise. The term "sheet" herein refers to a usually flimsy physical sheet of paper, plastic, or other suitable physical print media substrate for images, whether precut or web fed. The term "sheet stacking tray" broadly encompasses various sheet stacking bins or drawers unless indicated otherwise. A "print job" is normally a set of related such sheets, usually one or more collated or other sets copied from a set of original document sheets or electronic document page images from a particular user, or for a particular customer, or otherwise related.

As to specific components of the subject apparatus or methods, or alternatives therefor, it will be appreciated that, as is normally the case, some such components are known per se in other apparatus or applications, which may be additionally or alternatively used herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or method described in the examples below, including the drawing figures (which are approximately to scale) wherein:

FIG. 1 is a schematic side view exposing the interior of one embodiment of an otherwise conventional stacking and/or other set finishing finisher unit with one example of the subject system for providing improved stacking tray stack supporting surfaces in a sheet stacking position inside of the finisher unit;

FIG. 2 is the same as FIG. 1 but showing the slid-out unloading position of the stacking tray in which operator handholds have been automatically provided in areas of the stacking tray that were automatically providing stacking support in the stacking position of FIG. 1;

Figure 5:
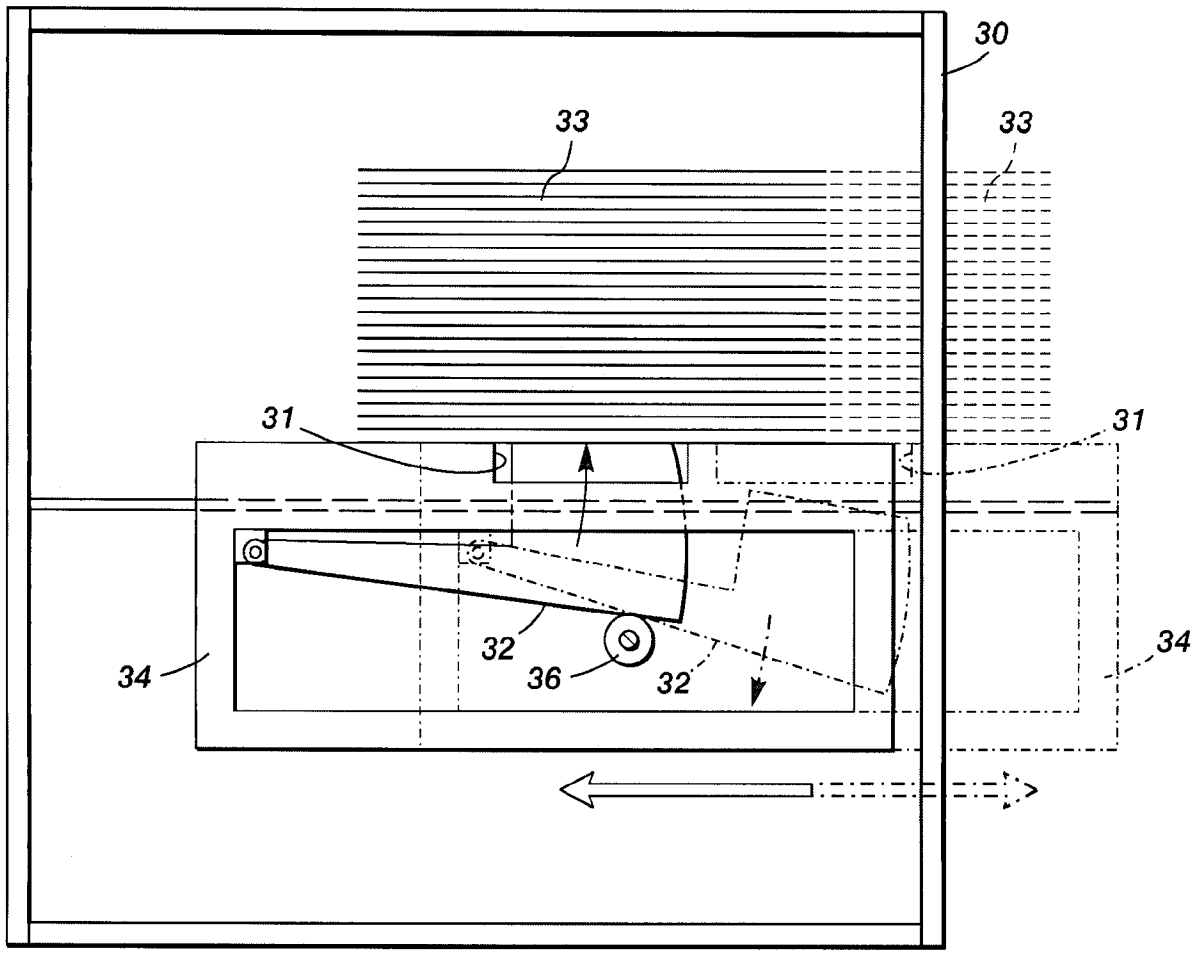
Figure 6:
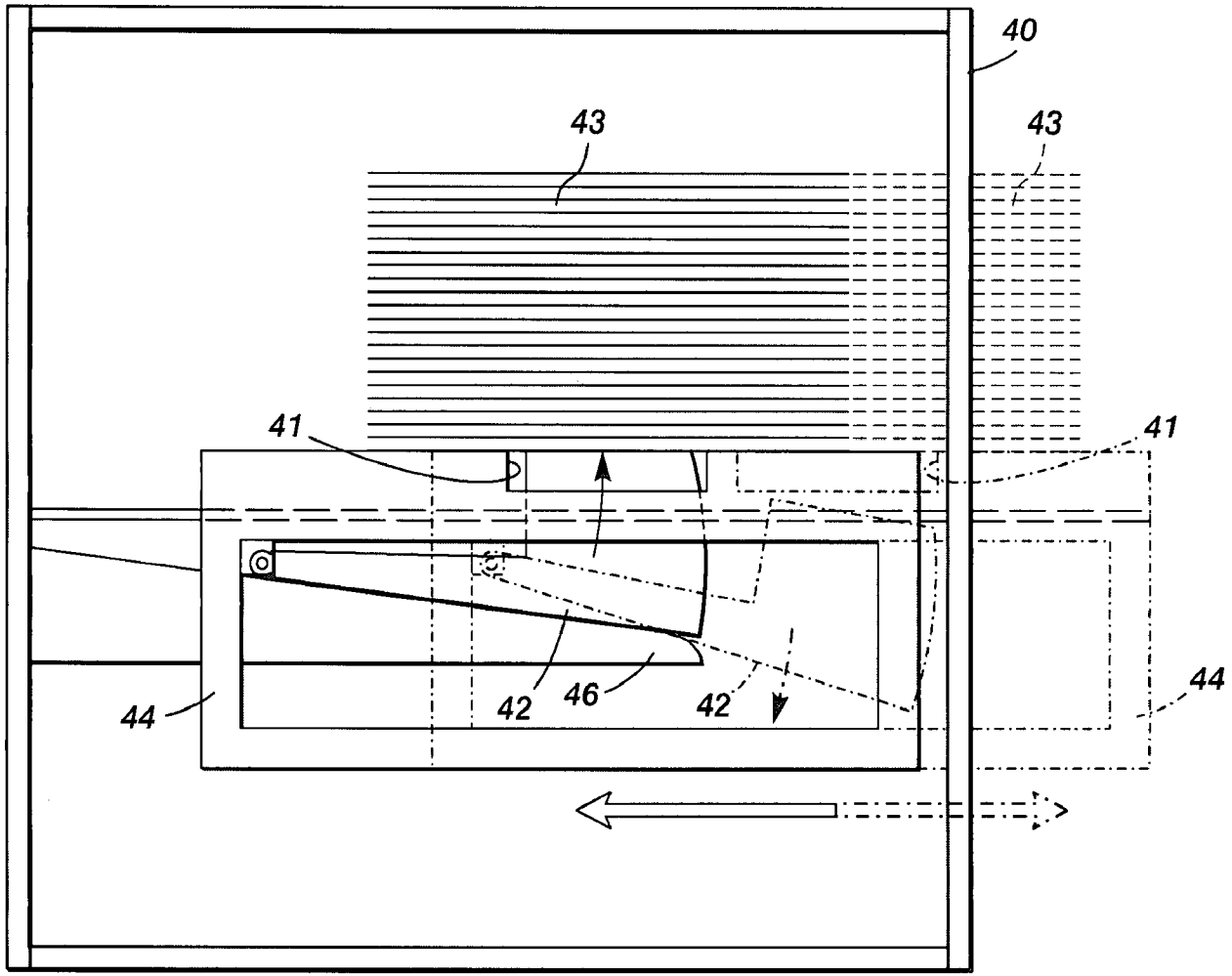
Figure 7:
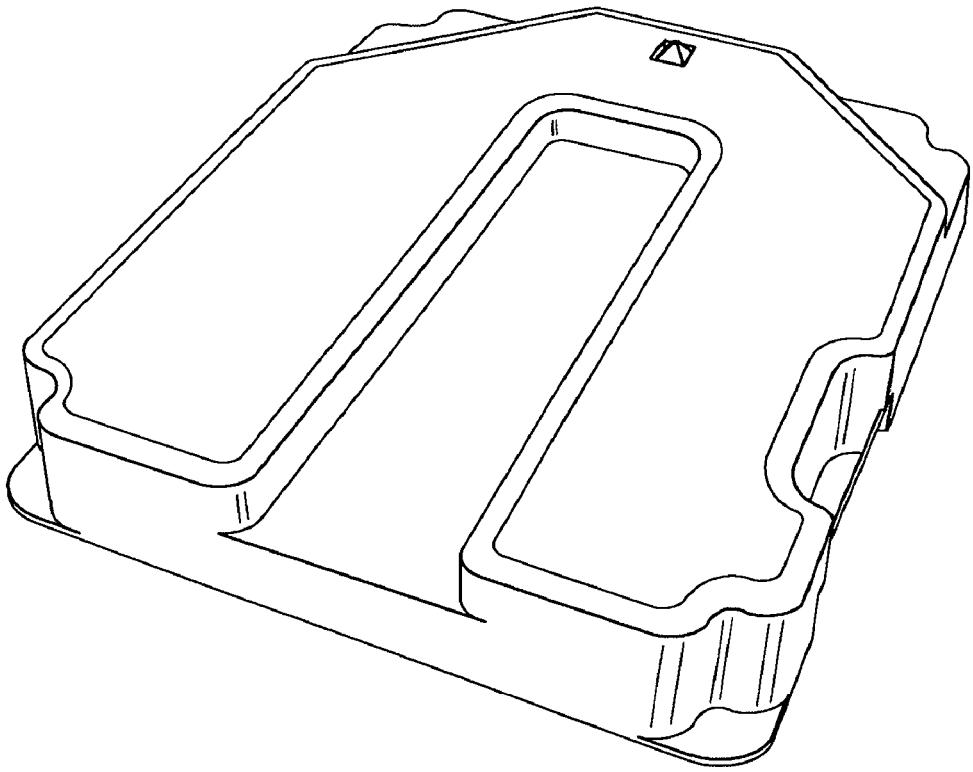
FIG. 7 PRIOR ART

FIG. 3 and 4 schematically illustrate a second mechanical embodiment of the system of FIGS. 1 and 2;

FIGS. 5 schematically illustrates a third mechanical embodiment of the system of FIGS. 1 and 2;

FIG. 6 schematically illustrates a third mechanical embodiment of the system of FIGS. 1 and 2; and FIG. 7, labeled "Prior Art," is an upper perspective view of the existing slide-out stacking tray of an existing printer finishing unit, showing its large unsupported sheet stacking areas provided for stack unloading handholds.

Describing now in further detail these four exemplary embodiments with reference to the Figures, there is shown the relevant output stacking tray area portions of otherwise conventional printer finisher modules 10, 20, 30 and 40 in their respective Figures as noted above. For clarity, the Figures are eliminating otherwise conventional printing, sheet feeding and finishing components. Such other conventional components are well know in the art, including the above-incorporated and other prior patents, and thus need not be re-described or re-illustrated herein.

As shown in the prior art example of FIG. 7, a current high capacity output stacker tray, such for a high volume printer, desirably has at least one handhold recess area under the stack of printed and finished sheets to be removed, and preferably two, on different sides, as shown. This allows the machine operator to place his or her hand below the completed stack of paper during the operator's stack unloading from the stacking tray. This handhold must, of course, be large enough to readily accommodate an operator's hand.

However, especially with larger size print media papers such as U.S. "legal size" 8.5×14, and/or thinner sheets with less beam strength, etc., such relieved handhold areas in the stacking tray can cause non-planar stacking. The sheets of the stack can sag or droop into handhold areas which are not providing a sheet stacking supporting surface, obstructing those handhold areas and/or causing the stack to curve up on the inboard and outboard edges, thus splaying or deforming the stack from a desired square (fully superposed) sheet stack. Also, when this happens, if the finisher unit has stack curl sensors, those curl sensors may be activated and shut down the printing system. This problem can be exacerbated by individual sheet cross-curl, which can be caused, for example, by the printer fuser, especially for certain types of printed images.

The four disclosed illustrated embodiments have somewhat different mechanisms but are all relatively simple and low cost mechanisms that can automatically provide full support for substantially the entire bottom surface of the stack whenever the sheet stacker is being used for stack support in the machine, that is, during sheet printing and stacking. Yet, as shown, all of these same stack supporting mechanisms automatically deactivate and move out of the way when the stacking tray is moved out to an unload position, to expose handhold stack lifting positions under the stack. Since these operator handhold areas under the stack are only required when the stacking tray is moved partially or entirely out of the finisher to its unload position, the sheet stack will not drop into the handholds during sheet stacking and trigger curl sensors or cause other stacking problems. The stack will be fully supported during individual sheet, or finished sheet-set, drops onto the top of the stack throughout the stacking function. The operator handhold areas of the stacking tray are only automatically opened for stack unloading when the stacking tray is moved out to an unload position.

Thus, this system allows for a full planar surface support of a stack during the stacking position of a stacking tray, while also alternatively allowing for an easily accessed handhold for unloading of the stack when the stacking tray is in the unload position. These embodiments all make use of the fact that a typical existing high capacity stacking tray may be already equipped, as shown, to easily slide out horizontally on simple rails or tracks at least partially to the outside of a finisher during the unloading of the stacking tray. By making use of this existing stacking tray slide-out motion to actuate the exemplary mechanisms, these embodiments can meet both a stacking support requirement and a customer accessibility requirement without any added motors or other power actuators. The change between the two stack supporting modes may be entirely manually actuated with low force.

Turning now to the details of the respective illustrated examples, FIGS. 1 and 2 show the slide-out stacking tray 12 with a sheet stack 13 having slide members 14 that in the stacking position of FIG. 1 are cammed up by a fixed cam track surface 15 inside the finisher module 10, so that their upper surfaces 14A are held substantially flush with the stacking tray 12 stacking surface 12A, thereby filling what would otherwise be handhold recess areas 16 not otherwise supporting the stack 13. When the stacking tray 12 is pulled out for unloading, as in FIG. 2, the slide members 14 automatically drop down as shown by the movement arrow to fully open the handhold recess areas 16 for operator hand insertion, because the slide members 14 are now no longer held up by the fixed cam track surface 15 inside the finisher module 10.

The alternative system of unit 20 of FIGS. 3 and 4 shows a fixed horizontal linear motion supporting rod or plate member 22 with an associated spring-loading 23. In the FIG. 3 stacking or pushed-in position of this stacking tray 24 the supporting member 22 is automatically pushed into and slides through the handhold area 25 at nearly the same level as the stacking tray stacking surface 24A to provide stacking support there. When the stacking tray 24 is slid out for unloading, the spring loading 23 automatically pulls back the supporting member 22 out of the handhold area 25 to allow free access.

The system of the unit 30 of FIG. 5 involves automatically pivoting up a pivotal handhold area 31 filling member 32 to a stack 33 supporting position when the tray 34 is moved in for stacking by its camming engagement with a fixed roller 36, and then letting this member 32 drop down out of the handholding area 31 by gravity as the tray 34 is moved out for unloading of the stack 33, as shown in the respective solid and phantom lines and movement arrows.

The system of the unit 40 of FIG. 6 similarly involves automatically pivoting up a similar pivotal member 42 to fill the handhold area 41 to provide full support of the stack 43 when the tray 44 is moved in for stacking by camming engagement with a fixed camming surface 46, and then letting this pivotal member 42 drop down out of the handholding area 41 by gravity as the tray 44 is moved out for unloading of the stack 43, as shown in the respective solid and phantom lines and movement arrows.

These respectively illustrated designs may, of course, be altered or optimized, but the underlying concept involves providing stacking support in a stacking position and automatically removing part of that support and providing instead a large and readily operator accessible handhold for stack unloads with the movement of the stacking tray from its stacking position to its unloading position. Since the tray is moved for stack unloads, this design automatically separates in position and time the existing conflicts of needing proper stack support for even stacking yet needing a handhold that provides for operator stack lifting during stack unloading.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A slide out sheet stacking and unloading system comprising: a sheet stacking tray with a support surface and manually slidable between a sheet feeding position and an unloading position, said support surface having at least one recess to allow manual access underneath a stack of sheets on said support surface;

A supplemental stack support mechanism disposed adjacent to said tray being movable between a position into said recess so as to be substantially flush with said support surface thereby providing a temporary supplemental sheet stacking support surface and a position removed from said recess thereby permitting said manual access;

A fixed cam having a slope positioned below said tray and said supplemental stack support mechanism in slidable contact with said supplemental stack support mechanism wherein sliding of said tray from said unloading position to said sheet feeding position causes said supplemental stack support mechanism to engage said slope so as to move into said recess and movement of said tray from said sheet feeding position to said unloading position causes said supplemental stack support mechanism to engage said slope so as to move to said position removed from said recess.

2. The sheet stacking and unloading system of claim 1 wherein said supplemental stack supporting mechanism is removed from said recess solely by movement of said tray with a sloped surface of said fixed cam during said downward movement of said stacking tray between said sheet feeding position and said unloading position.

3. The sheet stacking and unloading system of claim 1 wherein said sheet stacking tray is located above said fixed cam and manually movable between said sheet feeding position and said unloading position, and wherein said supplemental stack supporting mechanism is actuated solely by engagement with said fixed cam during said movement of said stacking tray between said sheet feeding position and said unloading position.

4. The sheet stacking and unloading system of claim 1, wherein said stacking tray is enabled to be horizontally manually movable between said sheet feeding position and said unloading position, and wherein said supplemental stack supporting member is an integral unit of said tray and movable down said fixed cam and actuated solely by engagement with said fixed camming member.

5. A sheet feeding and unloading method comprising providing a sheet stacking tray with a support surface and manually slidable between a sheet feeding position and an unloading position, providing said support surface with at least one recess to allow manual access underneath a stack of sheets on said support surface;

Disposing a supplemental stack support mechanism adjacent to said tray, moving said support mechanism to a position into said recess so as to be substantially flush with said support surface and, subsequently, providing said supplemental stack support to a position removed from said recess and thereby permitting said manual access underneath a stack of sheets on said support surface;

Providing a fixed cam having a slope positioned below said tray and said supplemental stack support mechanism to be in slidable contact with said supplemental stack support mechanism, sliding said tray on said fix cam from said unloading position to said sheet feeding position to cause said supplemental stack support mechanism to engage said slope and thereby move into said recess and providing movement of said tray from said sheet feeding position to said unloading position, causing thereby said supplemental stack support mechanism to engage said slope so as to move to said position removed from said recess.

6. The sheet stacking and unloading method of claim 5 wherein said stacking tray is manually horizontally moved between said sheet stacking position and said sheet unloading position, and wherein said supplemental sheet stack supporting member is solely downwardly moved by said manual movement of said stacking tray between said sheet feeding position and said sheet unloading position.

* * * * *